US007191989B2

(12) United States Patent
Berfield

(10) Patent No.: US 7,191,989 B2
(45) Date of Patent: Mar. 20, 2007

(54) HOSE HOLDER

(76) Inventor: Robert C. Berfield, 3681 Nichols Run Rd., Jersey Shore, PA (US) 17740-8600

( * ) Notice: Subject to any disclaimer, the term of this patent is extended or adjusted under 35 U.S.C. 154(b) by 45 days.

(21) Appl. No.: 10/807,006

(22) Filed: Mar. 23, 2004

(65) Prior Publication Data

US 2005/0211854 A1 Sep. 29, 2005

(51) Int. Cl.
*A47G 29/00* (2006.01)

(52) U.S. Cl. ..... 248/90; 248/80; 24/339; 15/323

(58) Field of Classification Search ..... 248/80, 248/83, 89, 90, 79, 81, 65, 53, 56, 150, 75; 15/323, 314, 351; 24/339, 545
See application file for complete search history.

(56) References Cited

U.S. PATENT DOCUMENTS

| | | | | | |
|---|---|---|---|---|---|
| 2,313,423 | A * | 3/1943 | Dodd | ..... | 15/246.4 |
| 2,819,485 | A | 1/1958 | Sparklin | ..... | 15/323 |
| 2,955,790 | A * | 10/1960 | Sylvester | ..... | 248/65 |
| 3,747,166 | A * | 7/1973 | Eross | ..... | 248/75 |
| 3,872,538 | A * | 3/1975 | Crouser | ..... | 15/323 |
| 4,406,434 | A * | 9/1983 | Schneckloth | ..... | 248/83 |
| 5,029,792 | A | 7/1991 | Desjardins | ..... | 248/309 |
| 5,079,802 | A * | 1/1992 | Blase et al. | ..... | 24/16 R |
| 5,137,156 | A | 8/1992 | Riezinger et al. | ..... | 211/13 |
| 6,311,936 | B1 | 11/2001 | Herr et al. | ..... | 248/75 |
| 6,405,414 | B1 * | 6/2002 | Byrnes et al. | ..... | 24/339 |
| 6,446,915 | B1 * | 9/2002 | Ismert | ..... | 248/68.1 |
| 6,478,342 | B1 | 11/2002 | Berfield | ..... | 285/276 |
| 6,502,276 | B2 * | 1/2003 | Iversen | ..... | 15/323 |
| 6,619,596 | B1 * | 9/2003 | Caine et al. | ..... | 248/49 |
| 6,700,064 | B2 * | 3/2004 | Aoki et al. | ..... | 174/69 |
| 6,715,721 | B2 * | 4/2004 | Buck | ..... | 248/74.2 |

* cited by examiner

*Primary Examiner*—A. Joseph Wujciak, III
(74) *Attorney, Agent, or Firm*—Hooker & Habib, P.C.

(57) ABSTRACT

A holder for storing ribbed vacuum cleaner hoses that includes a pair of support members mounted on a support, each support member having one or more ribs to engage the ribbed surface of the hose. The ribs include a lip that prevents displacement of the hose away from the support.

21 Claims, 5 Drawing Sheets

HOSE HOLDER

FIELD OF THE INVENTION

The invention relates to a holder for corrugated vacuum cleaner hoses and the like.

DESCRIPTION OF THE PRIOR ART

Vacuum cleaners are common household, shop, and outdoor tools. Many vacuum cleaners have a body containing an air pump and a depository for debris. The body is connected to a hose used to draw air and debris into the machine. Specialized cleaning tools are attached to the free end of the hose to facilitate cleaning tasks.

Vacuum cleaner hoses come in a variety of sizes and diameters. Smaller diameter hoses are preferred for collecting liquid debris and interior house cleaning, while larger diameter hoses are useful for collecting larger debris found in a workshop or outdoors. One vacuum cleaner can use a number of different size hoses.

The hoses are long, stiff and intentionally non-collapsible. Commonly, vacuum hoses have circumferential or spiral wound corrugations that extend along the length of the hose. This structure increases hose strength and permits flexing of the hose but makes hose storage difficult.

Storage racks that can accommodate vacuum cleaner hoses are known. The racks may be wall mounted or mounted on the vacuum cleaner body. Some of these racks are constructed from molded plastic or metal frames. The racks are large, expensive and complicated to produce and assemble. They cannot be stored compactly, a feature desirable for reducing packaging and transport cost. Often, conventional racks are not designed to accept hoses of different diameters.

Installation of racks mountable on vacuum cleaner bodies is problematic. Racks must be made to custom fit specific vacuum cleaner designs. Racks must be mounted with care to vacuum cleaner bodies to avoid damaging the air pump or breaching the debris depository.

There is additional difficulty when vacuum cleaner hoses are stored in rooms with unfinished walls having exposed studs, such as closets, basements or garages. These rooms lack a continuous flat mounting surface. Conventional wall-mounted hose storage racks are difficult to mount on walls with exposed studs and do not make efficient use of available space between studs.

Therefore, there is need for a mountable holder for corrugated vacuum cleaner hoses that is inexpensive to produce and easy for a user to assemble and mount on a variety of support structures. The holder should accommodate vacuum cleaner hoses of various diameter sizes and types and should be compact for efficient shipping and pre-sale display.

SUMMARY OF THE INVENTION

The invention is a two-part mounted holder for corrugated vacuum cleaner hoses. The holder can be mounted on a variety of supports such as flat walls, unfinished walls having exposed studs, directly to a vacuum cleaner body, handles attached to a vacuum cleaner body, and the like. The holder stores coiled corrugated vacuum cleaner hoses of different types and sizes and consists of a pair of hose support members preferably molded from thermoplastic. The holder is compact and can be easily and inexpensively produced.

Each support member has a base and at least one hose engaging rib projecting outwardly from the base. A lip preferably extends from the outer end of each rib to keep a hose from falling off the holder.

The support members are mounted across from each other on a support so that the ribs on each support member face each other and each rib extends outwardly from the support. The support may be a continuous flat surface, such as a wall or a side of a vacuum cleaner body; a non-continuous flat surface such as a wall having exposed wall studs; or two separated support structures, such as a pair of spaced apart beams, tubular vacuum cleaner handles, and the like.

In use, a corrugated vacuum cleaner hose is coiled and opposite sides of the coil are compressed to fit between the support members. The hose is then positioned between the support members and released. As the hose expands, the outer sides of the coil engage the ribs on the support members. The ribs fall into or seat in the valleys on the outer sides of the hose. The spring resilience of the coiled hose forces the hose against the ribs and holds the hose in place on the support members. If required, the hose can be coiled a number of times before being positioned between the support members and released.

When the support members are mounted on a flat surface or between exposed wall studs, lips on the outer ends of the ribs will overlie a coiled hose placed in to the holder so that the lips hold the hose against the wall to prevent the hose from moving outwardly from the wall and off the holder.

When the support members are mounted on a support having two separated support structures, each rib preferably has a pair of lips extending outwardly from opposite ends of the rib. The hose is retained between the pair of lips to prevent the hose from moving off the holder.

When the holder is mounted on a support that is a wall or other vertical structure, the hose is held perpendicular to the ground. The holder also functions when the support is a wall or other structure not perpendicular to the ground. The holder is capable of positioning a hose at a variety of angles relative to the ground.

Each hose support member preferably has two spaced ribs. Alternatively, each support member may have a single hose engaging rib.

Other objects and features of the invention will become apparent as the description proceeds, especially when taken in conjunction with the accompanying five sheets of drawings illustrating three embodiments of the invention.

DESCRIPTION OF THE PREFERRED EMBODIMENT

Figure 1:
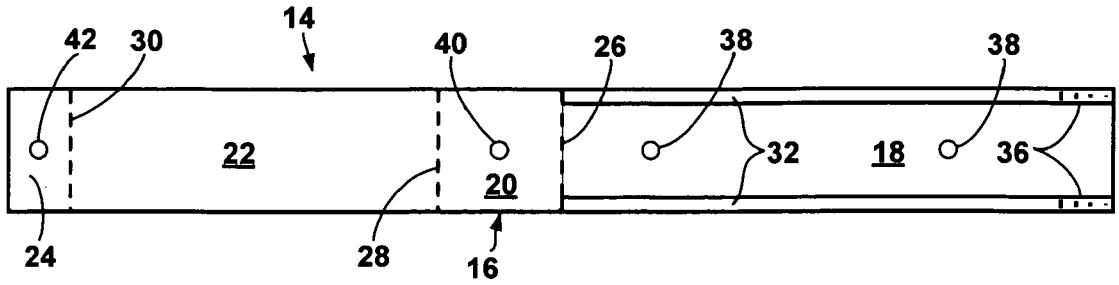
FIG. 1 is a top view of a preform for a first embodiment hose support member.
Figure 2:
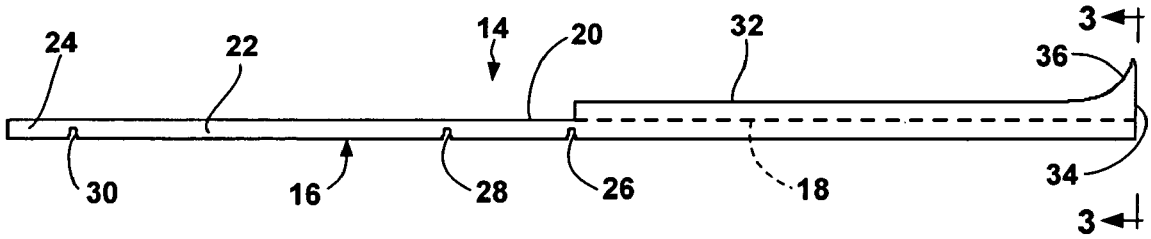
FIG. 2 is a side view of the preform shown in FIG. 1.
Figure 3:
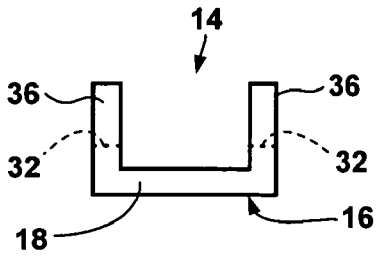
FIG. 3 is an end view of the preform shown in FIG. 1 taken along line 3—3 of FIG. 2.

Corrugated vacuum cleaner hose holder 10 (see FIG. 5) includes two hose support members 12 each formed from a molded plastic preform 14 shown in FIGS. 1–3.

Perform 14 includes an elongate rectangular base 16 extending the length of the preform. Rectangular base 16 has a uniform thickness. The base is made up of an elongate support panel 18 located at one end of the preform, a short support panel 20, an arm panel 22 and an attachment panel 24. Reduced thickness hinges 26, 28 and 30 join panels 18 and 20, panels 20 and 22 and panels 22 and 24 respectively.

A pair of hose support ribs 32 extend along the length of support panel 18 from hinge 26 to preform end 34. The ribs have a height above base panel 18 sufficient to extend into the valleys between corrugations in a vacuum cleaner hose. At end 34, the ribs extend outwardly above base support panel 18 to form hose retention lips 36. A pair of mounting holes 38 extends through base support panel 18. Mounting holes 40 and 42 extend through panels 20 and 24. Ribs 32 parallel each other and extend perpendicularly outwardly from base panel 18.

Figure 4:
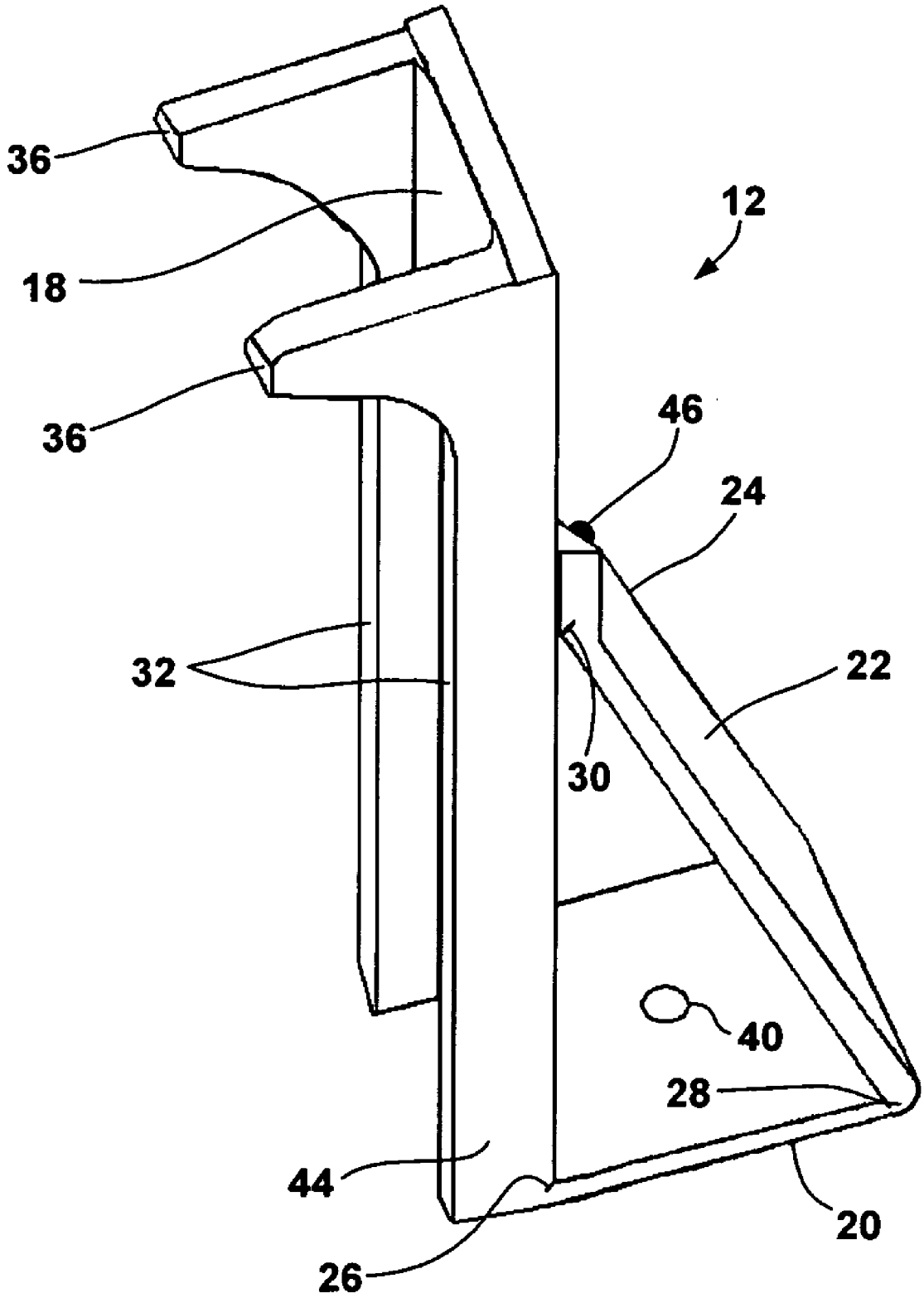
FIG. 4 is a perspective view of a first embodiment support member formed from the perform shown in FIGS. 1–3.

Preform 14 shown in FIGS. 1–3 may be folded to form hose support member 12 shown in FIG. 4. Support panel 18 is shown in the vertical position. Support panel 20 has been bent 90 degrees down from a position shown in FIG. 1 about hinge 26 so that it extends 90 degrees away from the lower end 44 of panel 18. Panel 22 is bent relative to panel 20 about hinge 28 through an angle greater than 90 degrees and angles back toward the upper end of panel 18. Panel 24 is bent through a shallow angle about hinge 30 and rests flush on panel 18, with hole 42 in panel 24 in alignment with hole 38 in panel 18. A suitable fastener 46, which may be a nut and bolt (or other threadable fastener), a pop rivet, or the like, extends through holes 42 and 38 to hold panel 24 against panel 18. Panel 22 supports panel 18 with ribs 32 extending outwardly as shown.

Figure 5:
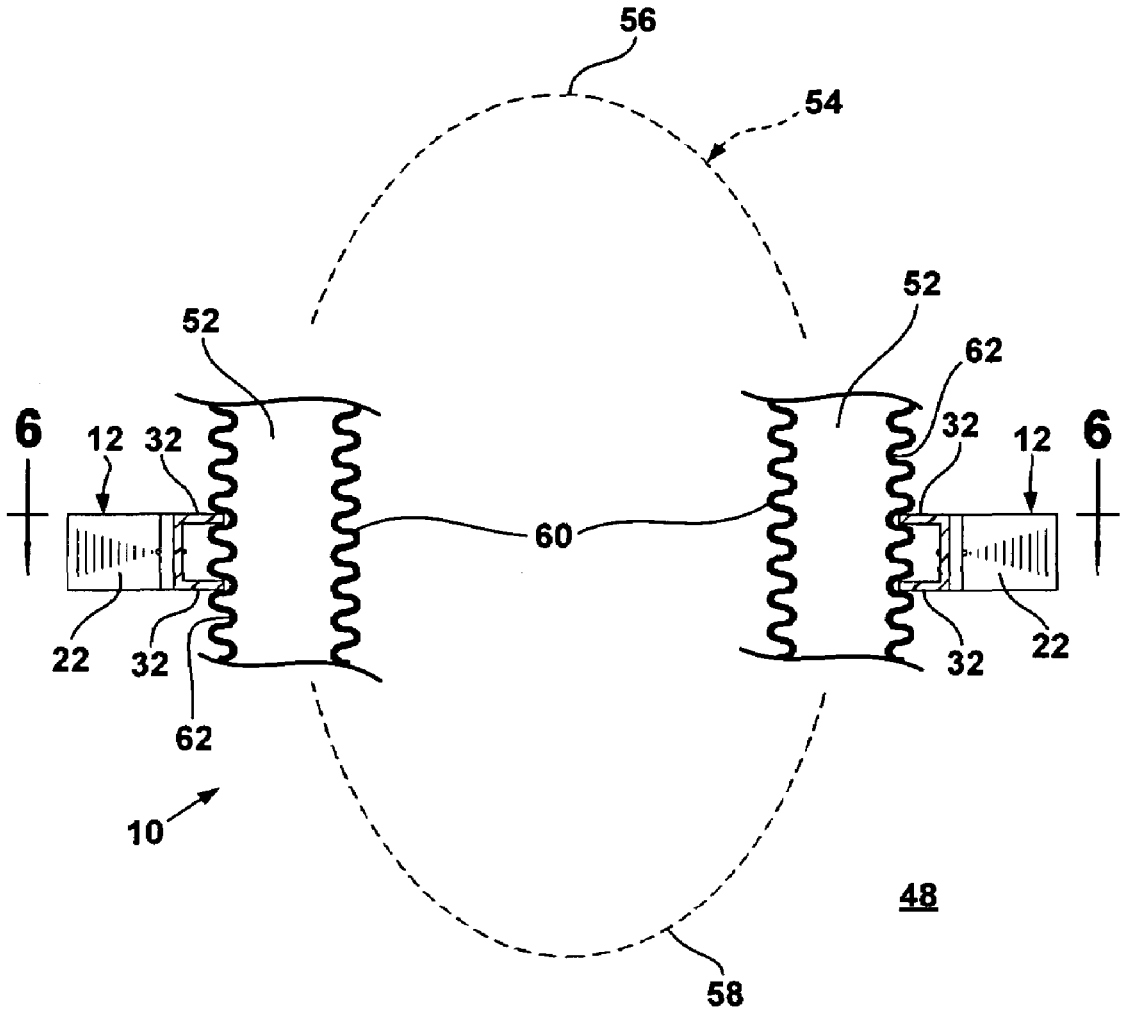
FIG. 5 is a front view, partially broken away, of a first embodiment hose holder with a pair of support members shown in FIG. 4.

FIG. 5 illustrates hose holder 10 supporting a coiled hose 52. Support members 12 are across from each other with ribs 32 facing each other.

Vacuum cleaner hose 52 may be formed from a corrugated plastic tube and is stiffly flexible about the corrugations. The corrugations may be spiral wound or circumferential. In order to mount hose 52 in holder 10, the hose is coiled into an elastically bowed section 54 having curved end sections 56 and 58 and side sections 60 extending between the end sections. The resiliency of the hose resists coiling and forms a spring biasing sides 60 outwardly or away from each other.

The coiled hose is placed in holder 10 by moving the sides 60 of the elastically bowed section 54 together a distance sufficiently close to permit moving the hose toward the wall past lips 36 and between the ribs 32 of each support member 12. Elastically bowed section 54 is then released so that the side sections 60 move outwardly of section 54 due to the spring bias of the hose. Side sections 60 then engage ribs 32 as shown. The ribs 32 fit into valleys 62 between adjacent corrugations on the hose. The resiliency of the hose retains side sections 60 in engagement with ribs 32 so that the two support members 12 support the coiled hose on wall 48. Lips 36 prevent the coiled hose from moving outwardly from wall 48 and off holder 10.

FIG. 5 illustrates a single coil hose in holder 10. If desired, a number of coils may be held. The hose is easily removed from the holder 10 by moving side sections 60 together away from adjacent support members 12 and then withdrawing the hose away from the holder 10.

Holder 10 may also be used to support a corrugated vacuum cleaner hose having two side sections 60, a curved upper section extending between the side sections 60, and lower ends hanging free below side sections 60. The resiliency of the curved upper section forms a spring that holds side section 60 outwardly in engagement with ribs 32 as described.

Figure 6:
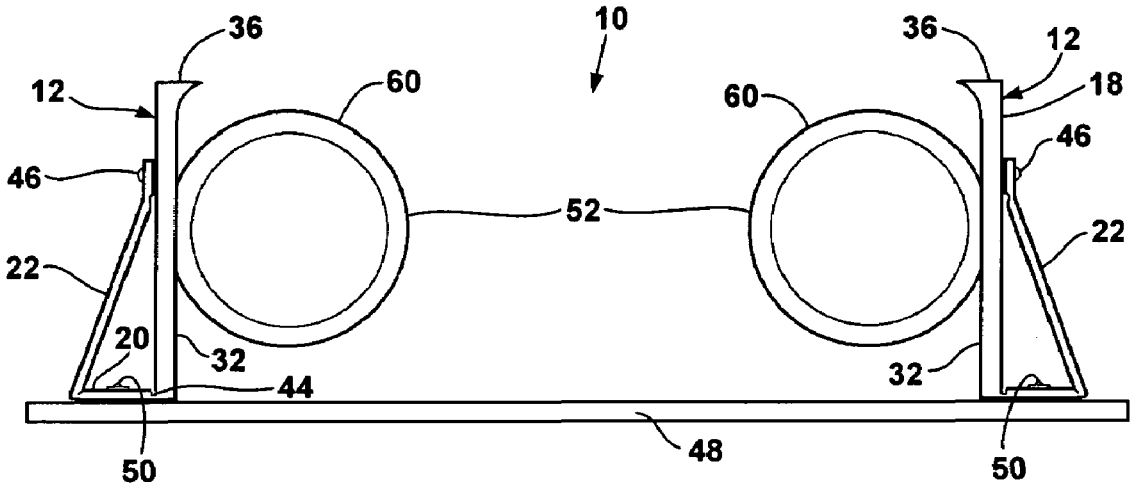
FIG. 6 is a sectional view taken along line 6—6 of FIG. 5, with the holder mounted on a vertical wall.

FIG. 6 illustrates hose holder 10 mounted on a vertical wall 28 and holding hose 52. The two hose support members 12 are mounted at the same level on vertical wall 48 with the ribs 32 of each support member facing the other support member. Panels 20 rest flush on wall 48 and are secured to the wall by suitable fasteners 50 extending through holes 40. As illustrated, the arm panels 22 support the panels 18 against outward deflection caused by hose 52 being mounted between the two hose support members 12.

Figure 7:
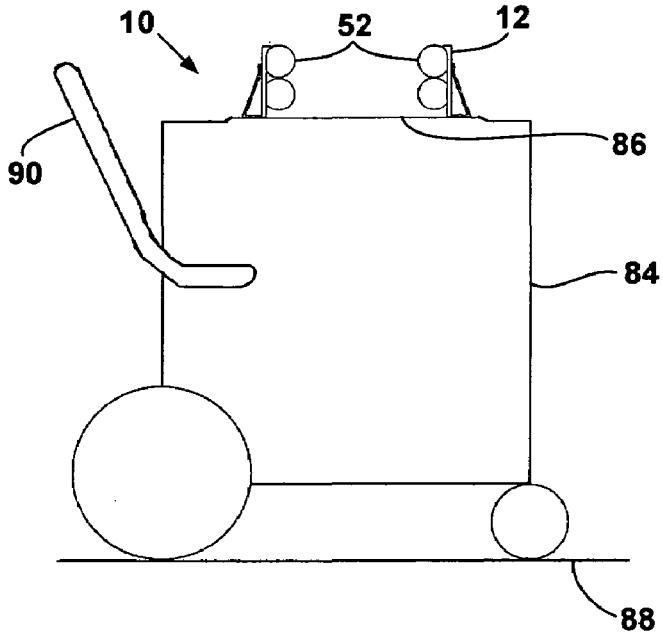
FIG. 7 is a side view, partially broken away, of the first embodiment hose holder mounted on a vacuum cleaner body.

FIG. 7 illustrates hose holder 10 mounted on a vacuum cleaner body 84. Body 84 has a flat surface 86 so that the holder is normally parallel to ground 88. The support members 12 are spaced sufficiently apart to hold a hose like hose 52. The hose is coiled, compressed, moved into the space between support members 12 and released as previously described. The orientation of holder 10 relative to the ground 88 does not affect use of holder 10.

A hose holder like holder 10 could also be integrally molded into vacuum cleaner body 84 with two integral support members like support members 12 having one or more ribs facing each other and spaced apart to receive a coiled hose. In yet another embodiment described further below, the hose holder is mounted on a handle 90 of vacuum cleaner body 84.

Figure 8:
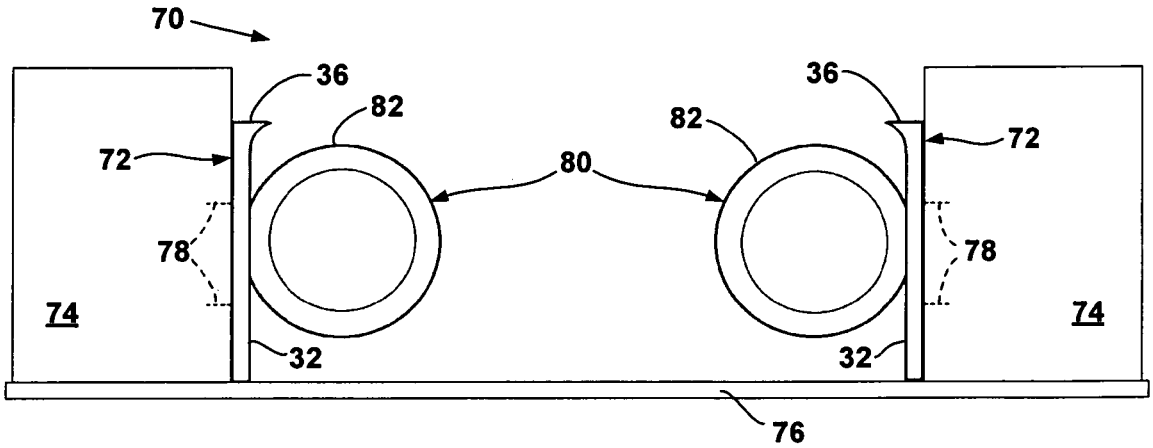
FIG. 8 is a view similar to FIG. 6 of a second embodiment hose holder mounted on exposed wall studs.

FIG. 8 illustrates a second embodiment hose holder 70 mounted on a pair of spaced apart wall studs 74. Holder 70 includes two hose support members 72. Each support member 72 is formed from a preform similar to perform 14 but including a support panel 18, with ribs 32 and lips 36. Base panels 20 and 22 shown in FIG. 1 are omitted and cut away at hinge 26.

Each support member 72 is attached to an interior surface of a stud 74 mounted on vertical wall 76 by suitable fasteners 78 extending through holes 38. Support members 72 extend outwardly perpendicularly from wall 76 at the same level with ribs 32 of each member facing the other member.

Holder 70 is shown holding coiled corrugated vacuum cleaner hose 80 between the two support members 72. The coiled hose is compressed, placed between support member 72, and then released so that the vertical sides 82 of the coil are elastically held outwardly into engagement with the inwardly facing ribs 32 to support the hose on wall 76.

The hose support members 12 and 72 each have two spaced hose retention ribs 32. The members may have single hose retention ribs as desired. A two-rib holder has the advantage that a mounting hole may be provided in the center of the support panel 18 and each member may be molded from a single mold. If a member were molded with a single side rib and a central mounting hole and the same member were mounted on both sides of the holder, the two ribs would be located at different levels, which would be aesthetically undesirable although functionally viable.

Figure 9:
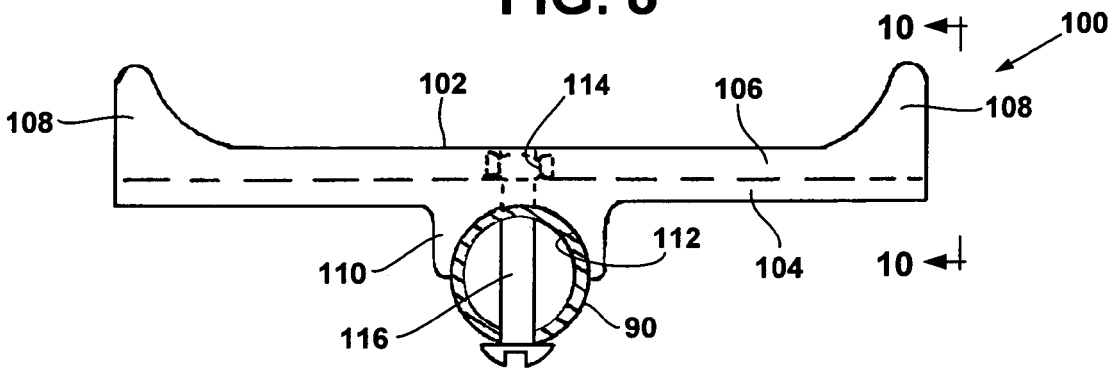
FIG. 9 is a side view of a third embodiment hose holder mounted on a tubular support.
Figure 10:
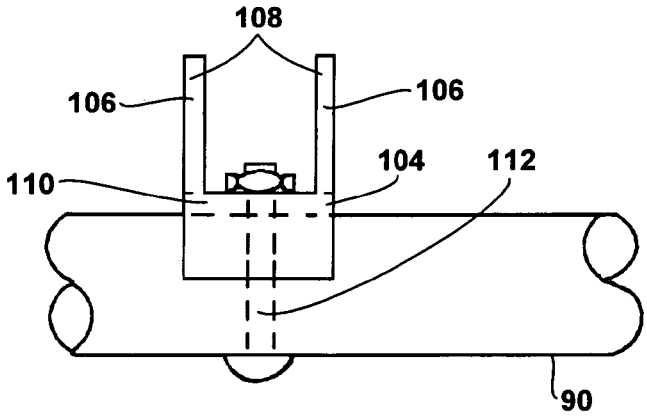
FIG. 10 is an end view of the third embodiment hose holder taken along line 10—10 of FIG. 9.

FIGS. 9 and 10 illustrate a third embodiment corrugated vacuum cleaner hose holder 100 suitable for mounting on tubular supports. Holder 100 includes two support members 102. Holder 100 is shown mounted on handle 90 of the vacuum cleaner body 84.

Each support member 102 has an elongate rectangular base 104 extending the length of the member. Rectangular base 104 has a uniform thickness. Two support ribs 106 extend along the length of base 104. Ribs 106 are similar to ribs 32 described above. Ribs 106 parallel each other and extend perpendicularly upward from base 104. Ribs 106 extend outwardly above each end of base 104 to form hose retention lips 108. Socket 110 formed on base 104 has a curved mounting surface 112 sized to receive the tubular support. Mounting hole 114 extends though base 104 and a socket 110.

The support members 102 are mounted on opposing sides of handle 90 so that the ribs 106 face each other. Handle 90 is received in sockets 110 and held by suitable fasteners 116 through the holes 114.

A coiled hose is mounted on holder 100 so that lips 108 retain the hose laterally and the compressed resiliency of the hose retains hose side sections in engagement with ribs 106 to capture the hose.

Sockets 110 may be adapted to receive supports having non-curved or irregular shapes in alternate embodiments.

Plastic hose support members are disclosed. If desired, the member may be made of other materials having sufficient strength to support hoses, including wood and metal.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. The combination of a corrugated hose and a holder for the hose wherein the holder comprises two spaced apart support members, each member including at least one rib facing the rib on the other member, each rib including a lip, the corrugated hose with valleys, the hose having an elastically bowed portion and side sections located to either side of the bowed portion, the side sections positioned between the ribs, said side sections being biased against the ribs by the bowed portion with each rib seated in a valley on a side section so that the ribs hold the hose in place, wherein said members are mounted on a wall and each lip is spaced from the wall.

2. The combination of claim 1 wherein at least one rib on each member includes a second lip, each second lip being located proximate the wall.

3. The combination of claim 1 wherein the ribs are generally horizontal and the hose extends generally vertically.

4. The combination of claim 1 wherein the ribs are generally vertical and the hose extends generally horizontally.

5. The combination of claim 1 wherein the members are secured to parts of a vacuum cleaner body.

6. The combination of claim 1 wherein the members each comprise a one-piece integral molded plastic body.

7. The combination of a corrugated hose, a holder for the hose, and a wall, wherein the holder comprises two spaced apart support members, each member including at least one rib facing the rib on the other member, the corrugated hose with valleys, the hose having an elastically bowed portion and side sections located to either side of the bowed portion, the side sections positioned between the ribs, said side sections being biased against the ribs by the bowed portion with each rib seated in a valley on a side section so that the ribs hold the hose in place, the support members are mounted on the wall or on one or more studs extending from the wall.

8. The combination of claim 7 wherein the ribs are generally horizontal and the hose extends generally vertically.

9. The combination of claim 7 wherein the ribs are generally vertical and the hose extends generally horizontally.

10. The combination of claim 7 wherein the members are secured to parts of a vacuum cleaner body.

11. The combination of claim 7 wherein the members each comprise a one-piece integral molded plastic body.

12. The combination of a corrugated hose and a holder for the hose wherein the holder comprises two spaced apart support members, each member mounted on a support and including at least one rib located outwardly from the support and facing the rib on the other member, each rib including a lip spaced from the support, at least one rib on each member including a second lip, each second lip located proximate the support, the corrugated hose with valleys, the hose having an elastically bowed portion and side sections located to either side of the bowed portion, the side sections positioned between the ribs, said side sections being biased away from each other by the bowed portion so that one valley on each side section engages one rib on each member to support the hose.

13. The combination of claim 12 wherein the ribs are generally horizontal and the hose extends generally vertically.

14. The combination of claim 12 wherein the ribs are generally vertical and the hose extend generally horizontally.

15. The combination of claim 12 wherein the members are secured to parts of a vacuum cleaner body.

16. The combination of claim 12 wherein the members each comprise a one-piece integral molded plastic body.

17. The combination of a corrugated hose and a holder for the hose wherein the holder comprises two spaced apart support members, each member mounted on a support, the support comprises a wall and the support members are mounted on the wall or on one or more studs extending from the wall, each member including at least one rib located outwardly from the support and facing the rib on the other member, each rib including a lip, the corrugated hose with valleys, the hose having an elastically bowed portion and side sections located to either side of the bowed portion, the side sections positioned between the ribs said side section being biased away from each other by the bowed portion so that one valley on each section engages one rib on each member to support the hose.

18. The combination of claim 17 wherein the ribs are generally horizontal and the hose extends generally vertically.

19. The combination of claim 17 wherein the ribs are generally vertical and the hose extends generally horizontally.

20. The combination of claim 17 wherein the members are secured to parts of & vacuum cleaner body.

21. The combination of claim 17 wherein the members each comprise a one-piece integral molded plastic body.

* * * * *

UNITED STATES PATENT AND TRADEMARK OFFICE

CERTIFICATE OF CORRECTION

PATENT NO. : 7,191,989 B2
APPLICATION NO. : 10/807006
DATED : March 20, 2007
INVENTOR(S) : Robert C. Berfield It is certified that error appears in the above-identified patent and that said Letters Patent is hereby corrected as shown below:

Col. 6, line 48 replace “Section” with --Sections--. (2nd occurrance)

Signed and Sealed this

Twenty-second Day of May, 2007

JON W. DUDAS
*Director of the United States Patent and Trademark Office*